US006817605B1

(12) United States Patent
Bohn

(10) Patent No.: US 6,817,605 B1
(45) Date of Patent: Nov. 16, 2004

(54) METHOD AND APPARATUS FOR CREATING A PILLOWLESS BOOKLET

(75) Inventor: Greg Bohn, Kuna, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/426,749

(22) Filed: Apr. 30, 2003

(51) Int. Cl.[7] ..... B41L 43/12

(52) U.S. Cl. ..... 270/37; 270/32; 493/445; 493/384; 412/30; 412/37

(58) Field of Search ..... 270/32, 37; 493/444, 493/445, 383, 384; 412/1, 3, 4, 5, 6, 8, 9, 19, 22, 23, 30, 37

(56) References Cited

U.S. PATENT DOCUMENTS

| | | | | |
|---|---|---|---|---|
| 5,108,081 A | | 4/1992 | Russel | |
| 5,377,965 A | | 1/1995 | Mandel | |
| 5,547,176 A | | 8/1996 | Williams | |
| 5,685,530 A | | 11/1997 | DeLise | |
| 6,074,332 A | * | 6/2000 | Helmstadter et al. | 493/254 |
| 6,199,851 B1 | | 3/2001 | Latvakangas | |
| 6,276,677 B1 | | 8/2001 | Hommochi | |
| 6,354,059 B1 | * | 3/2002 | Yoshie et al. | 53/117 |
| 6,363,851 B1 | | 4/2002 | Gerhard | |
| 6,692,208 B1 | * | 2/2004 | Watkiss et al. | 412/1 |

FOREIGN PATENT DOCUMENTS

| | | | | |
|---|---|---|---|---|
| JP | 2001260564 A | * | 9/2001 | B42C/5/02 |

* cited by examiner

*Primary Examiner*—Patrick Mackey
(74) *Attorney, Agent, or Firm*—James R. McDaniel

(57) ABSTRACT

An apparatus for creating a pillowless booklet, comprising: a means for accumulating a plurality of sheets to form a bundle; a means for fastening said plurality of sheets in said bundle operatively connected to said accumulating means; a means for forming a booklet spine edge operatively connected to said fastening means; and a means for flattening said booklet spine edge in order to create a pillowless booklet operatively connected to said booklet spine forming means, comprising; a crease wire; a crease roller located substantially adjacent to said crease wire; a guide operatively connected to said crease roller; a carriage roller operatively connected to said guide rail; and a clamp operatively connected to said guide rail.

8 Claims, 11 Drawing Sheets

METHOD AND APPARATUS FOR CREATING A PILLOWLESS BOOKLET

BACKGROUND OF THE INVENTION

1. Field of the Invention

This invention relates to a method and apparatus for producing a pillowless booklet by flattening the spine of the booklet.

2. Description of the Related Art

Prior to the present invention, as set forth in general terms above and more specifically below, it is known, in the booklet making art to employ opposing rollers to form the booklet. Exemplary of such prior art are U.S. Pat. No. 5,377,965 ('965) to B. P. Mandel et at., entitled "Automatic Online Signature Booklets Finisher for Electronic Printers," U.S. Pat. No. 6,276,677 ('677) to H. Hommochi et al., entitled "Sheet Bundle Folding Apparatus with Movable Push-in Member," and U.S. Pat. No. 6,354,059 ('059) to K. Yoshie et al., entitled "Sheet Finisher and Image Forming Apparatus Therein." While the devices of the '965, '677, and '059 references disclose various apparatus for forcing a flat sheet or sheet stack between opposing rollers, none of these references teach or suggest the use of an apparatus for flattening of the booklet spine in order to eliminate a raised or "pillow" condition at the spine. Consequently, a more advantageous system), then, would be provided if a booklet could be produced from a flat sheet stack such that the spine of the booklet was flattened in order to eliminate any pillow conditions at the spine.

It is apparent from the above that there exists a need in the art for an apparatus that is capable of creating a booklet, but which at the same time reduces the pillow condition of the spine by flattening the spine. It is a purpose of this invention to fulfill this and other needs in the art in a manner more apparent to the skilled artisan once given the following disclosure.

SUMMARY OF THE INVENTION

Generally speaking, an embodiment of this invention fulfills these needs by providing a method for creating a pillowless booklet, wherein the method is comprised of steps of: accumulating a desired number of sheets for the booklet; fastening the sheets together; folding the fastened sheets to form a booklet spine edge; and flattening the spine edge in order to substantially eliminate any pillows located adjacent to the spine edge.

In certain preferred embodiments, a stapling device and stapler anvil are used to fasten the sheets together. Also, a crease wire, clamping jaws, and crease rollers are used to fold the fastened seats in order to form the booklet spine edge. Finally, a V-shaped spine form roller is used to flatten the spine edge.

In another further preferred embodiment, substantially any raised areas or "pillowing" located adjacent to the booklet spine are eliminated through the use of the V-shaped spine form roller.

The preferred method for creating a booklet, according to various embodiments of the present invention, offers the following advantages: ease-of-use; substantial elimination of spine pillowing; good stability; good durability, excellent booklet creating characteristics; and good economy. In fact, in many of the preferred embodiments, these factors of ease-of-use, substantial elimination of spine pillowing, and excellent booklet creating characteristics are optimized to an extent that is considerably higher than heretofore achieved in prior, known booklet creating methods.

The above and other features of the present invention, which will become more apparent as the description proceeds, are best understood by considering the following detailed description in conjunction with the accompanying drawings, wherein like characters represent like parts throughout the several views and in which:

DETAILED DESCRIPTION OF THE INVENTION

Figure 1:
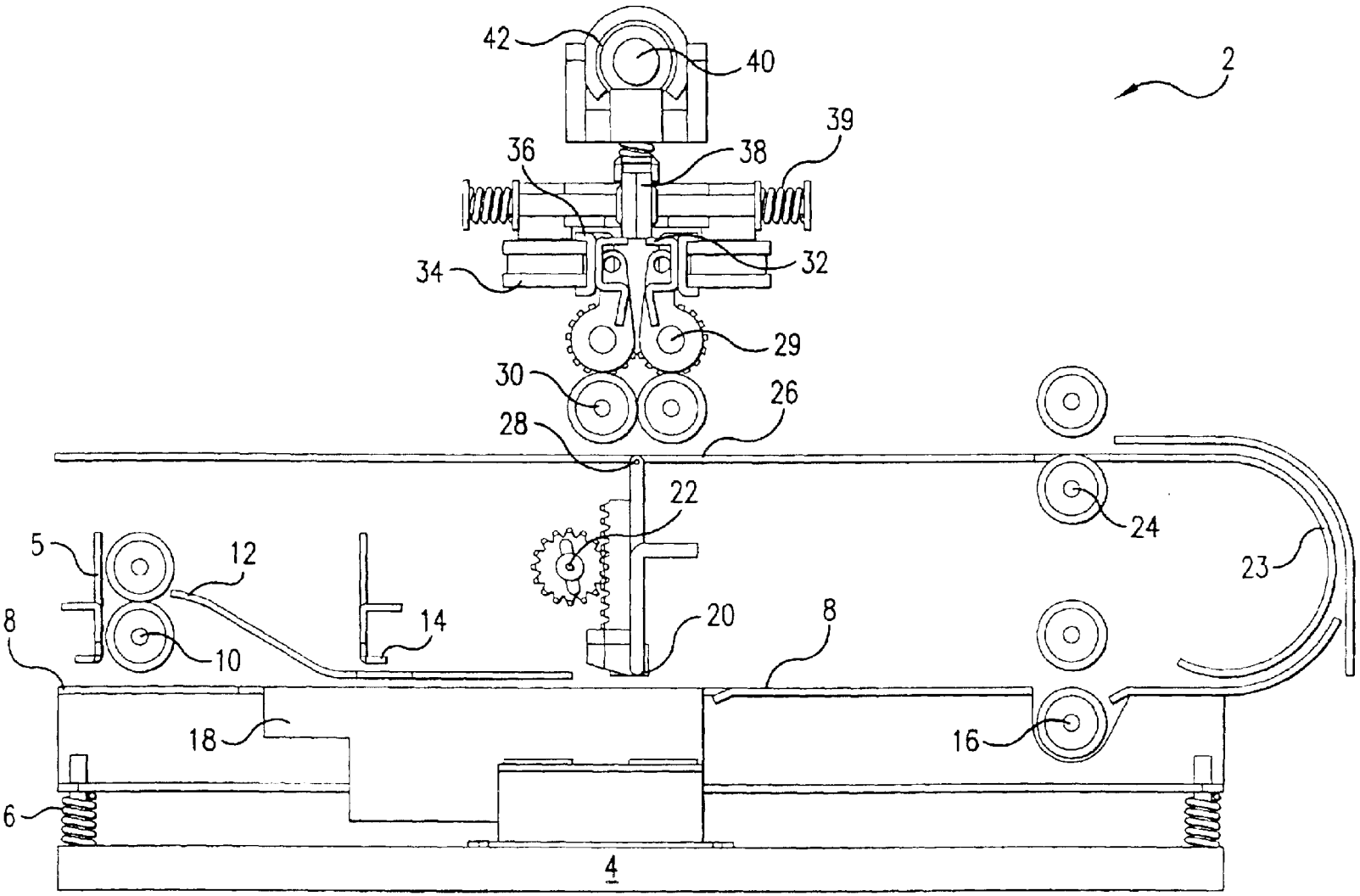
FIG. 1 is a front schematic illustration of an apparatus for creating a pillowless booklet, according to one embodiment of the present invention.

With reference first to FIG. 1, there is illustrated one preferred embodiment for use of the concepts of this invention. FIG. 1 shows apparatus 2 for creating a pillowless booklet. Apparatus 2 includes, in part, frame 4, bundle clamp 5, suspension 6, lower bundle plane 8, drive rollers 10, sheet diverter 12, bundle clamp 14, hand-off rollers 16, fastener 18, stapler anvil 20, anvil drive gear 22, bundle diverter 23, hand-off rollers 24, upper bundle plane 26, crease wire 28, jaw centering arm 29, crease rollers 30, clamping jaws 32, carriage centering rollers 34, carriage guide rail 36, spine form roller 38, spine form roller tensioner 39, carriage drive screw 40, and drive nut 42.

With respect to apparatus 2, frame 4, preferably, is constructed of any suitable, durable, rigid material. Bundle clamp 5, preferably, is constructed of any suitable, durable, rigid material. Suspension 6, preferably, is constructed so as to adequately provide suspension between frame 4 and the remainder of apparatus 2. Lower bundle plane 8, preferably, is constructed of any suitable, durable material that is capable of allowing media (element 3 in FIG. 3) to be held upon lower bundle plane 8 and traverse along lower bundle plane S. Drive rollers 10, preferably, are any suitable rollers that can introduce media on to sheet diverter 12. Sheet diverter 12, preferably, is constructed of any suitable, durable material. Bundle clamp 14, preferably, is constructed of any suitable, durable, rigid material. Hand-off rollers 16, preferably, are any suitable rollers that can introduce the bundle into bundle diverter 23. Fastener 18, preferably, is any suitable fastening device, such as a stapler, that is capable of fastening the sheets of the bundle together. Stapler anvil 20, preferably, is constructed of any suitable, durable, rigid material. Anvil drive gear 22, preferably, can be any suitable gear that is capable of moving stapler anvil 20 and crease wire 28 up-and-down. Hand-off rollers 24, preferably, are any suitable rollers that can introduce the bundle on to upper bundle plane 26. Upper bundle plane 26, preferably is constructed of any suitable, durable material that is capable of allowing the bundle to be held upon upper bundle plane 26 and traverse along upper bundle plane 26. Crease wire 28, preferably, is constructed of any suitable, durable, rigid material that is capable of pushing the bundle into jaw centering arm 29, crease rollers 30, clamping jaws 32, and spine form roller 38. Jaw centering arm 29, preferably, is constructed of any suitable, durable, rigid material that is capable of allowing clamping jaw 32 to traverse along its length. Crease rollers 30, preferably, are any suitable rollers that can introduce the bundle into clamping jaws 32 and spine form roller 38. Clamping jaws 32, preferably, are constructed of any suitable, durable, rigid material that is capable of clamping the bundle in order to retain the spine of the bundle. Carriage centering rollers 34, preferably, are any suitable rollers that are capable of traversing spine form roller 38 along the spine of the bundle. Carriage guide rail 36, preferably, is constructed of any suitable, durable, rigid material that is capable of allowing carriage-centering rollers 34 to traverse along its length. Spine form roller 38, preferably, is any suitable V-shaped roller that is capable of traversing along the spine of the bundle in order to flatten the spine. Carriage drive screw 40 and drive nut 42, preferably, can be any conventional drive screw and drive nut that are capable of driving spine form roller 38 along the spine of the bundle.

Figure 2:
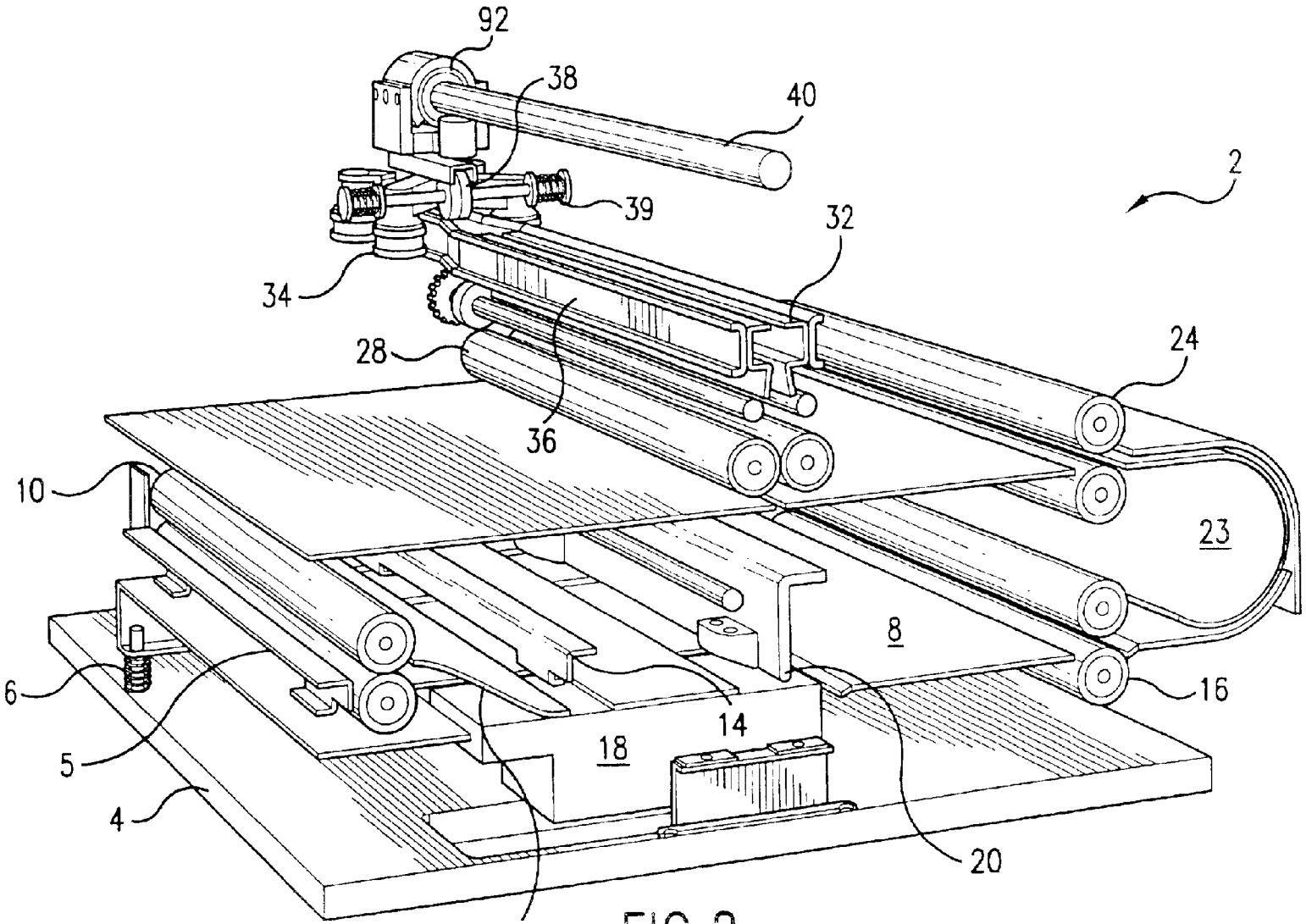
FIG. 2 is a cross-sectional view of the apparatus for creating a pillowless booklet as shown in FIG. 1, according to one embodiment of the present invention.

FIG. 2 is a cross sectional view of apparatus 2, as illustrated in FIG. 1. FIG. 2 more clearly shows how the various elements interact with each other.

Figure 3:
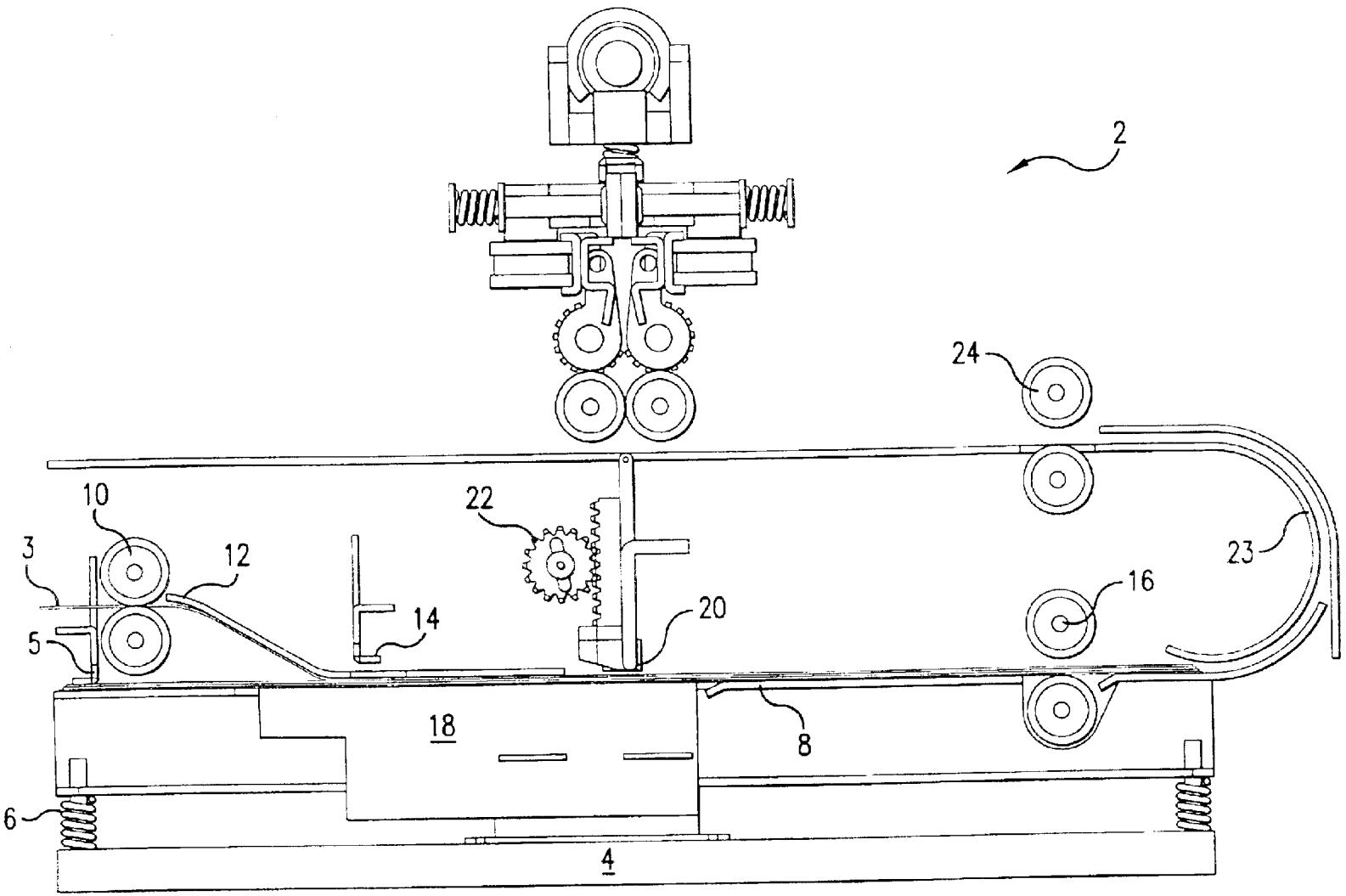
FIG. 3 is a front schematic illustration of the apparatus for creating a pillowless booklet, illustrating the sheet accumulation, according to another embodiment of the present invention.

FIG. 3 shows the introduction of media 3 into apparatus 2. It is to be understood that media 3 can be any suitable media upon which printing or other similar types of imaging can be placed. As shown in FIG. 3, bundle clamp 5 is conventionally moved to a downward or closed position to allow media 3 to come into contact with drive rollers 10. In this manner, sheet diverter 12 causes sheets of media 3 to accumulate along lower bundle plane 8.

Figure 4:
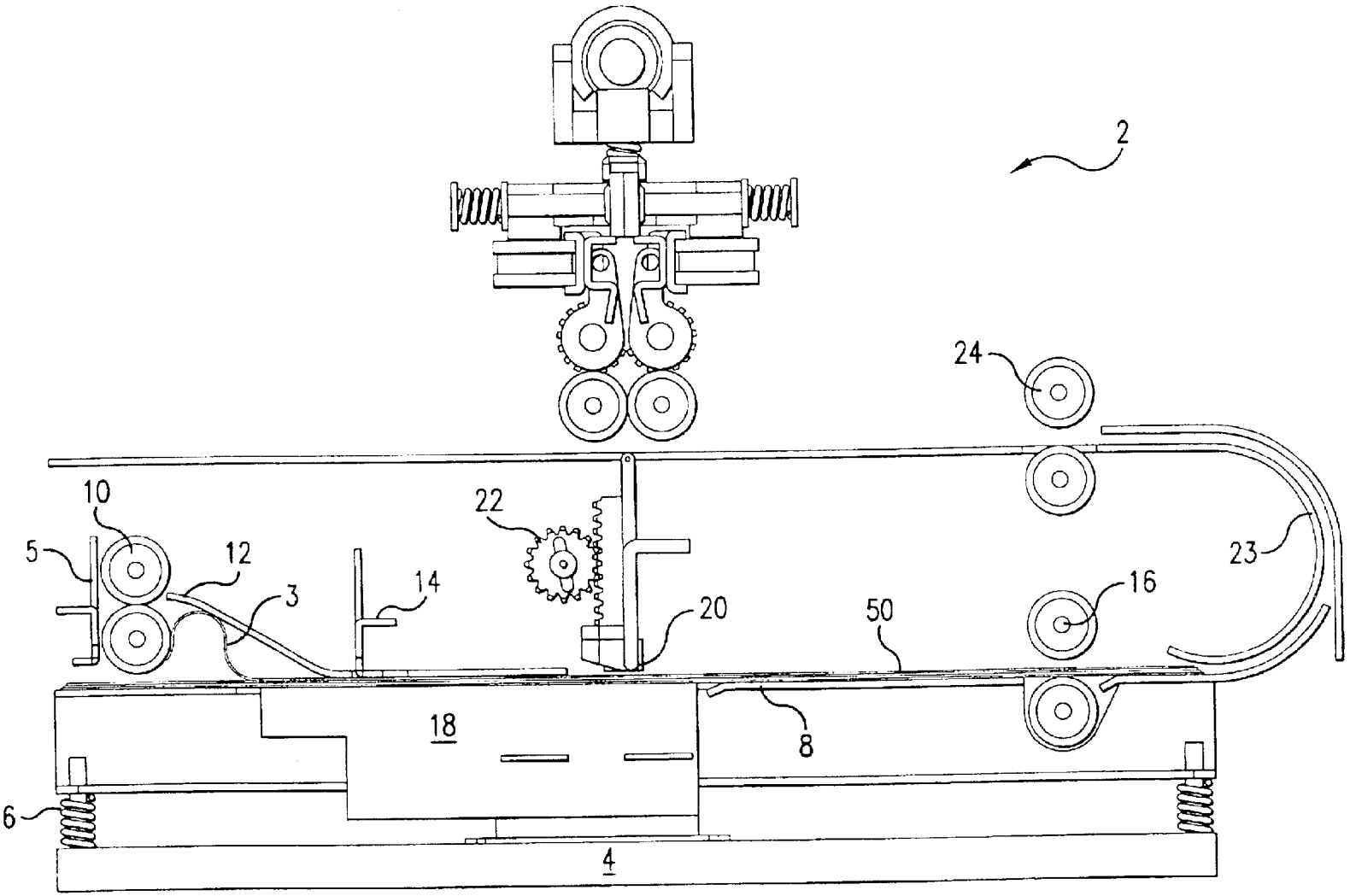
FIG. 4 is a front schematic illustration of the apparatus for creating a pillowless booklet, illustrating the sheet trailing edge buckle, according to another embodiment of the present invention.

As shown in FIG. 4, as a new sheet of media 3 is placed upon bundle 50, the sheet of media 3 is traversed along bundle 50. The various sheets of media 3 of bundle 50 are precut prior to being introduced into apparatus 2. In this manner, when the spine of bundle 50 is formed and flattened, the various media sheets of bundle 50 will align to form a straightedge, thereby resembling a booklet. Consequently, the various sheets of media 3 of bundle 50 must be placed upon bundle 50, as shown in FIG. 4, in order to produce a "stairstep" effect between the adjacent sheets of media 3 of bundle 50.

This is accomplished through the use of bundle clamp 14 and drive rollers 10. As a sheet of media 3 is introduced on to bundle 50, the leading sheet edge of media 3 is conventionally monitored so that when leading sheet edge of media 3 reaches a desired point along bundle 50, bundle clamp 14 is lowered or closed on to the sheet of media 3 and drive rollers 10 creates a trailing edge buckle that causes the trailing end of the sheet of media 3 to position itself at the other end (trailing end) of bundle 50.

Figure 5:
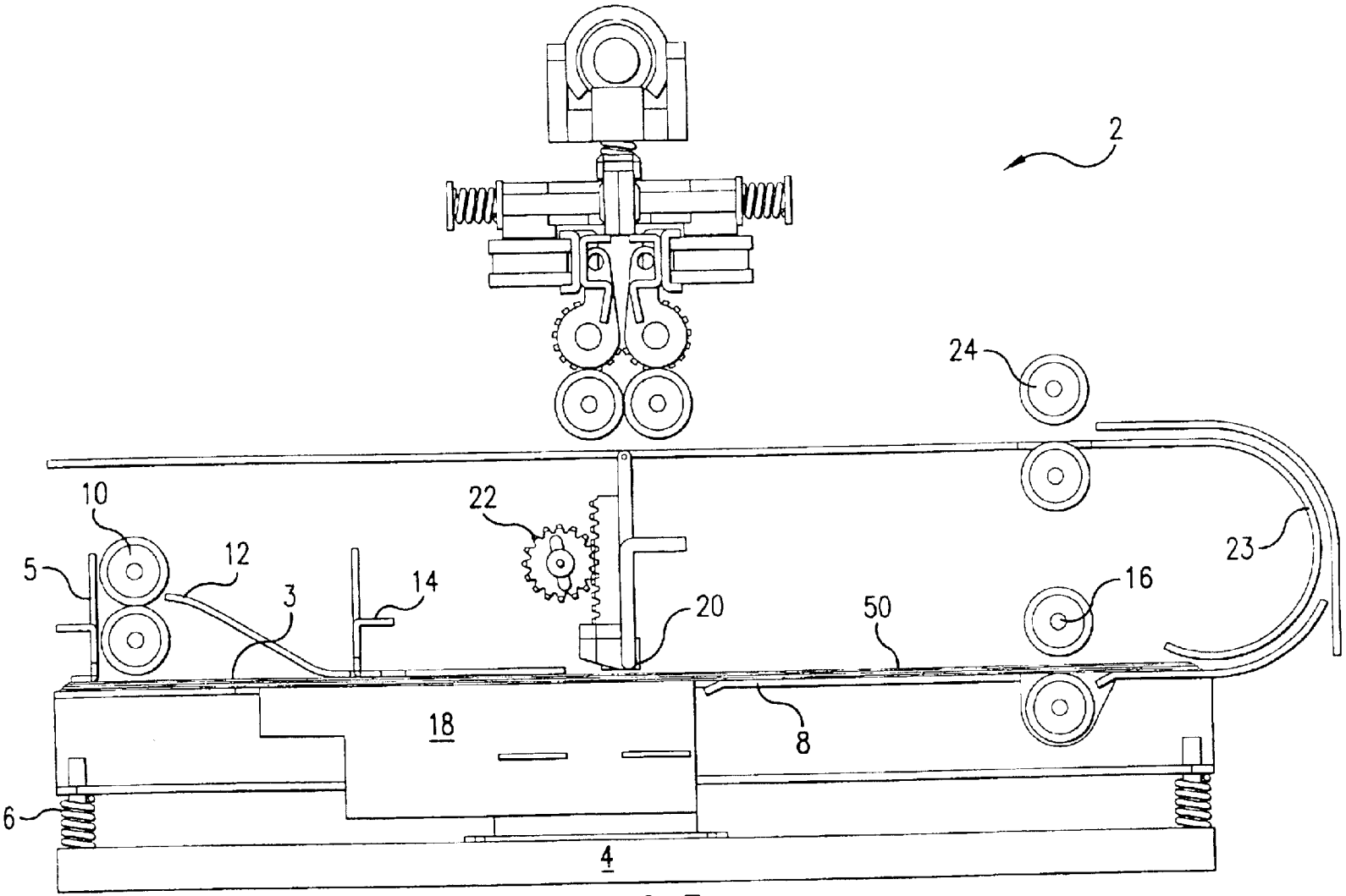
FIG. 5 is a front schematic illustration of the apparatus for creating a pillowless booklet, illustrating a full booklet sheet count, according to another embodiment of the present invention.

As shown in FIG. 5, after the desired number of sheets of media 3 are accumulated, in order to form bundle 50, bundle clamps 5 and 14 are conventionally lowered on to bundle 50 in order to hold bundle 50 in place.

Figure 6:
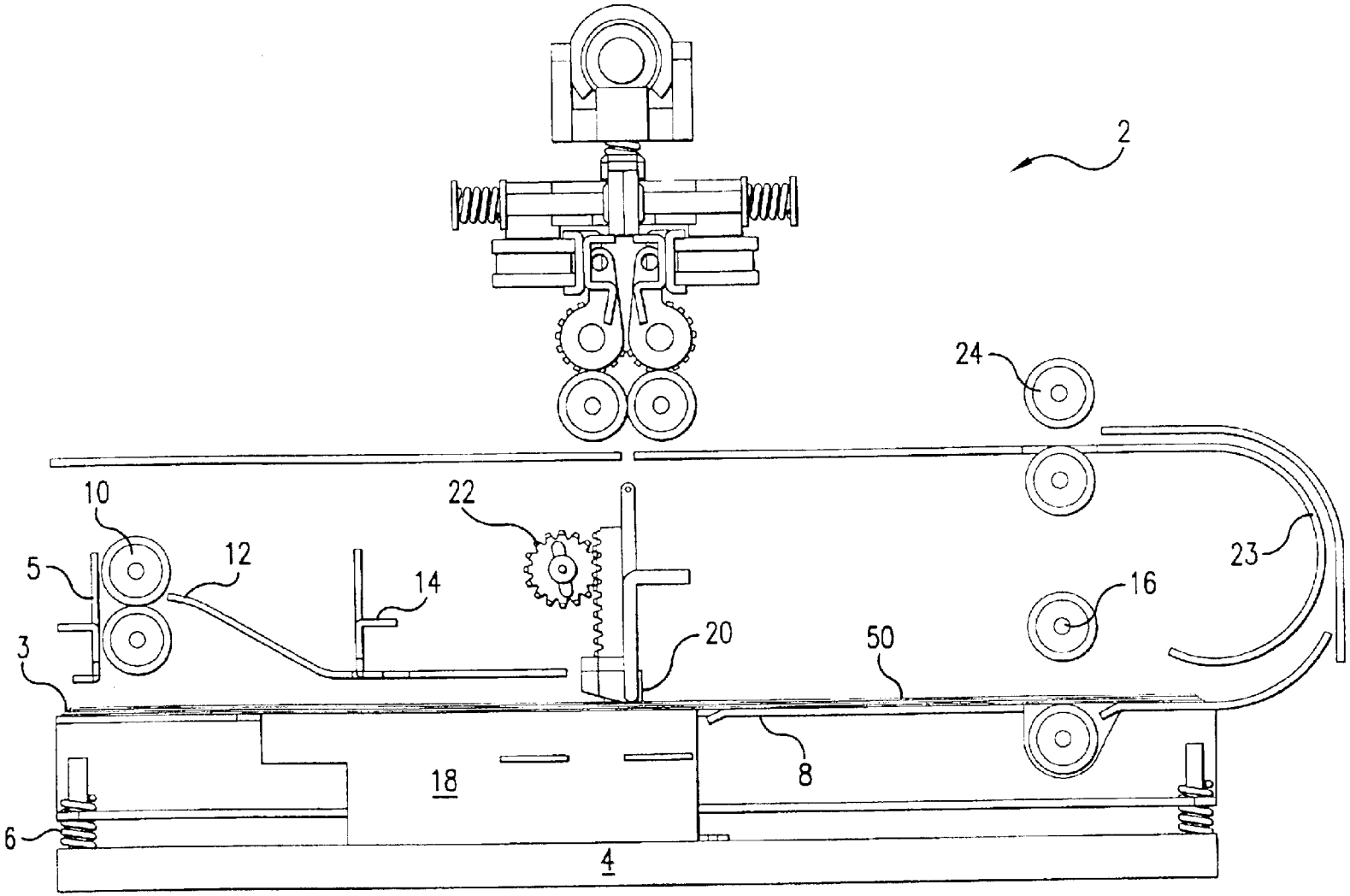
FIG. 6 is a front schematic illustration of the apparatus for creating a pillowless booklet, illustrating the fastening operation, according to another embodiment of the present invention.

As shown in FIG. 6, stapler anvil 20 is conventionally lowered by anvil drive gear 22 on to bundle 50 in order to fasten the sheets of media 3 of bundle 50 into place through the use of fastener 18. Also, bundle clamps 5 and 14 are conventionally raised.

Figure 7:
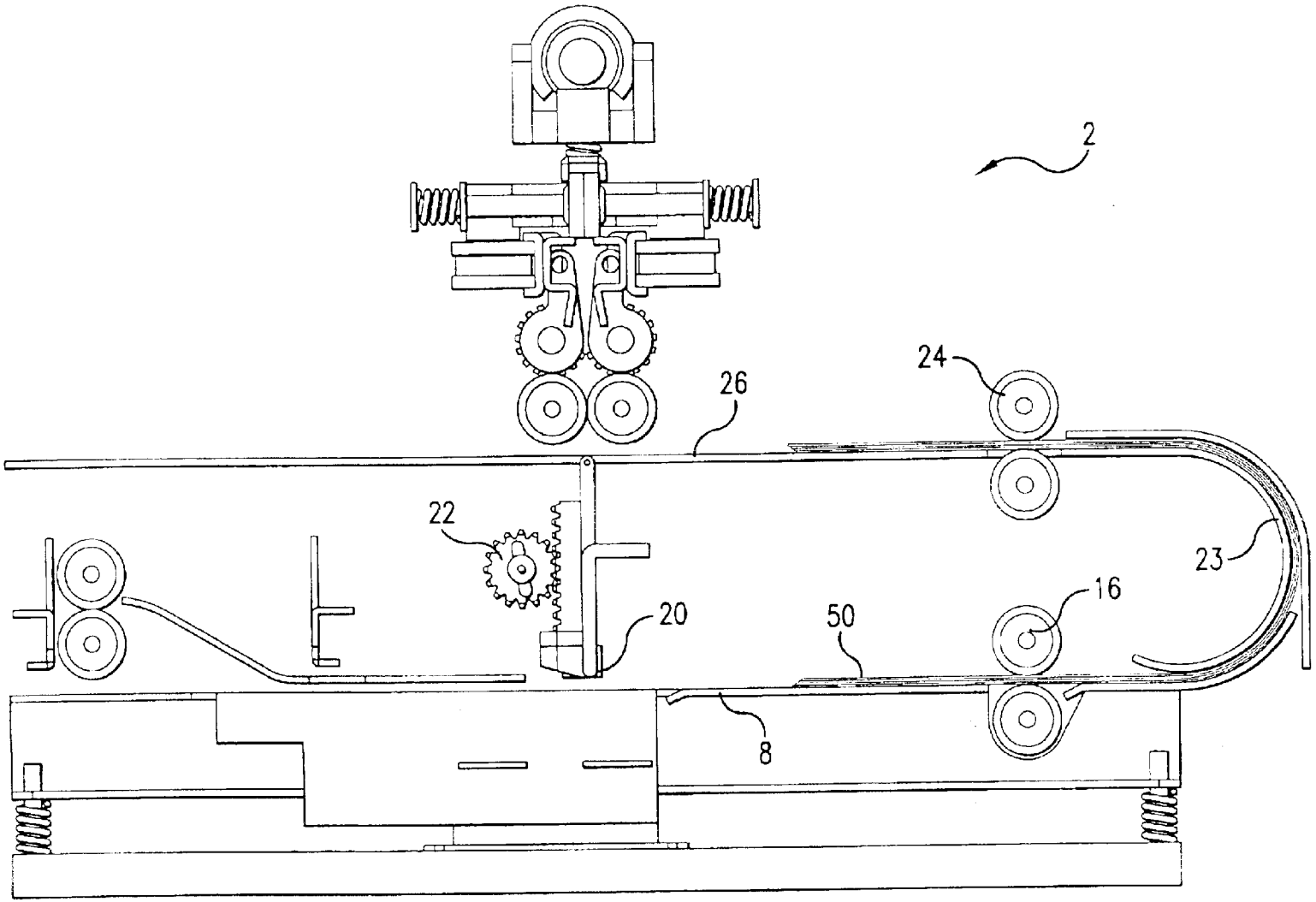
FIG. 7 is a front schematic illustration of the apparatus for creating a pillowless booklet, illustrating the fastened bundle handoff operation, according to another embodiment of the present invention.

As shown in FIG. 7, after bundle 50 has been fastened, hand-off rollers 16 interact with bundle 50 in order to cause bundle 50 to traverse along bundle diverter 23 and interact with hand-off rollers 24.

Figure 8:
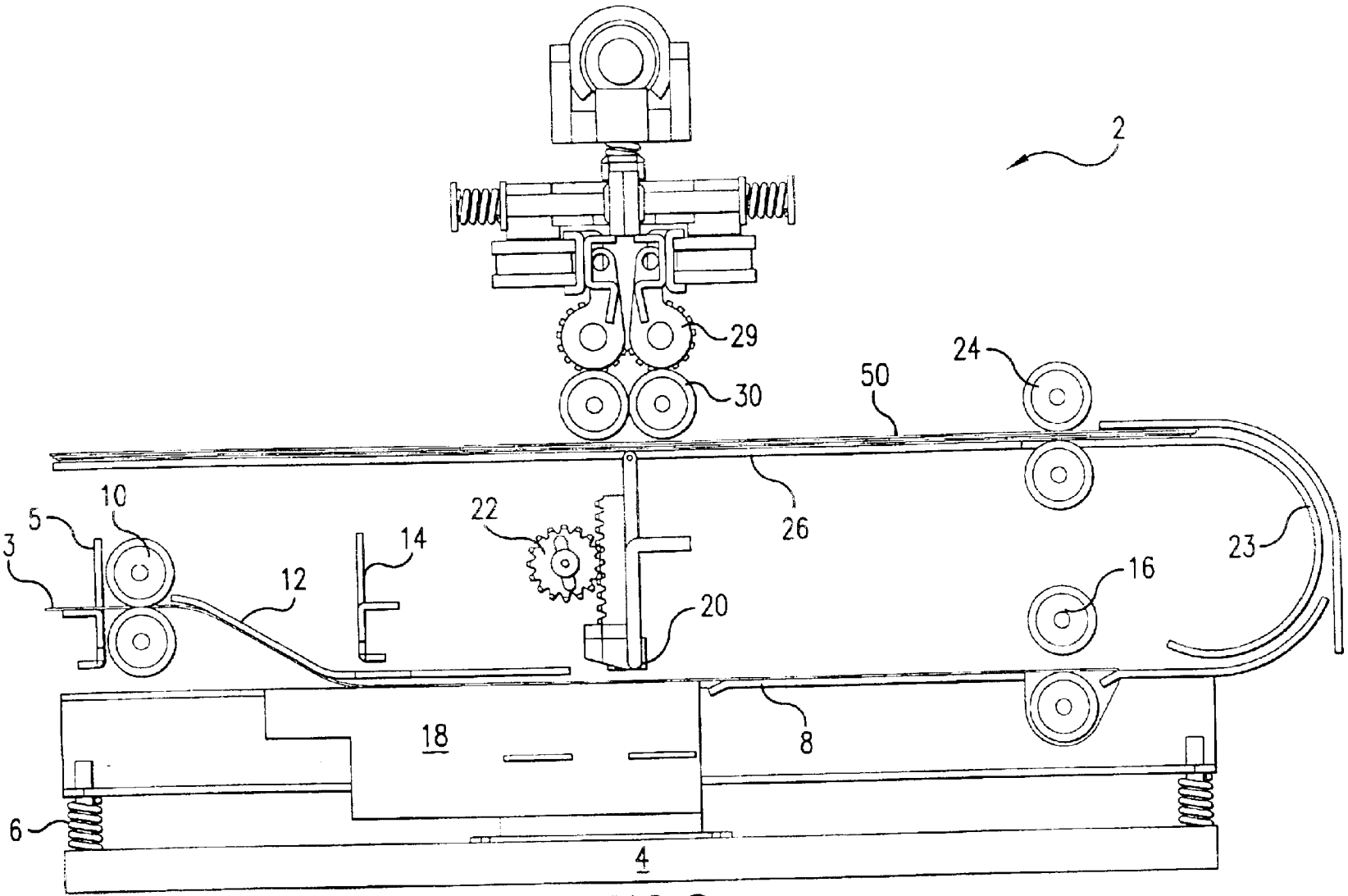
FIG. 8 is a front schematic illustration of the apparatus for creating a pillowless booklet, illustrating the bundle crease wire/fastener alignment, according to another embodiment of the present invention.

As shown in FIG. 8, hand-off rollers 24 traverse fastened bundle 50 along upper bundle plane 26 and conventionally centers the area where bundle 50 was fastened over crease wire 28. It must also be noted that once bundle 50 has been transferred to upper bundle plane 26, another sheet of media 3 can be introduced on to lower bundle plane 8 in order to begin the formation of another bundle 50.

Figure 9:
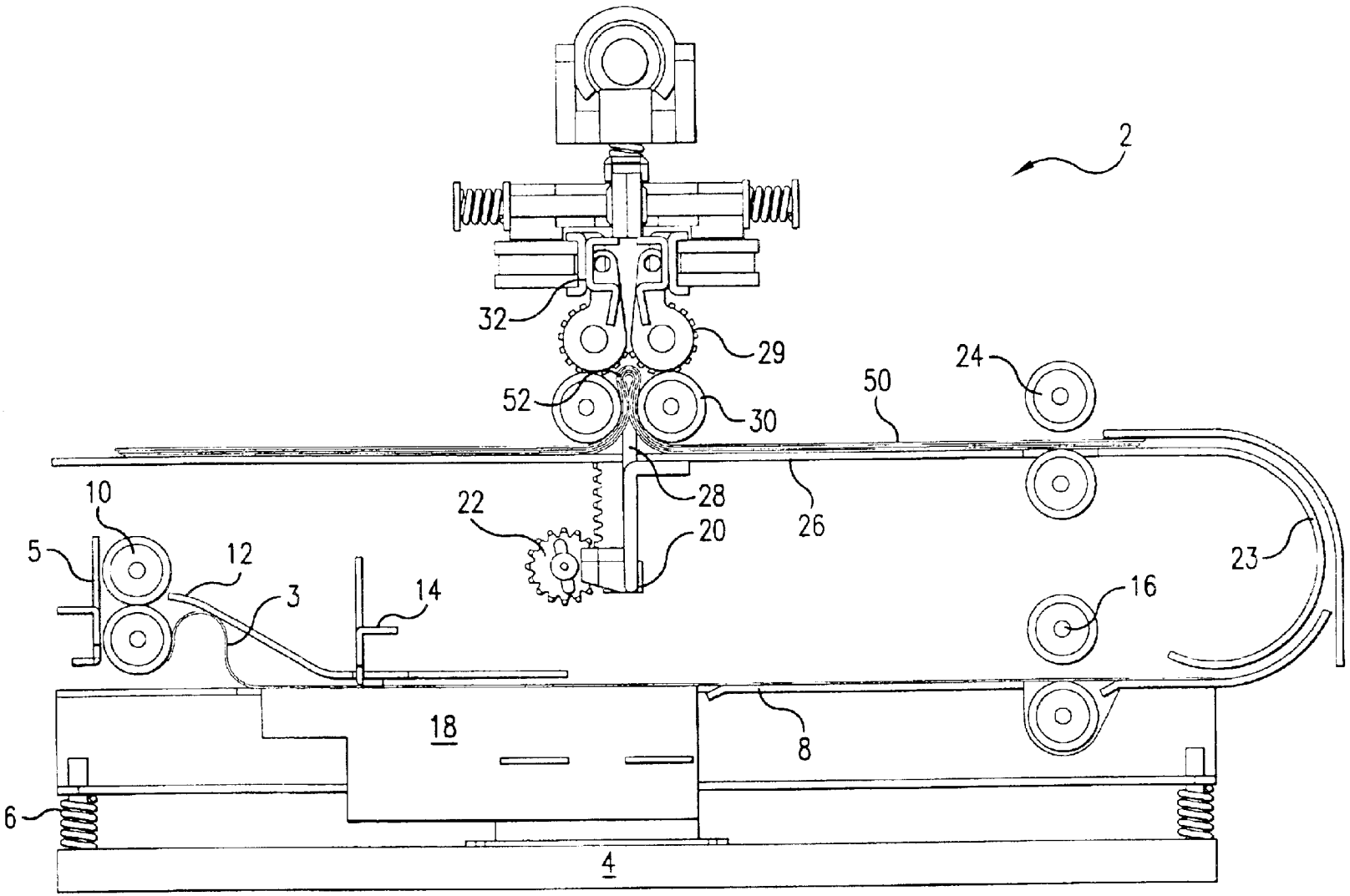
FIG. 9 is a front schematic illustration of the apparatus for creating a pillowless booklet, illustrating the bundle crease operation, according to another embodiment of the present invention.

As shown in FIG. 9, crease wire 28 is conventionally raised by anvil drive gear 22 such that spine 52 in bundle 50 is formed between crease rollers 30.

Figure 10:
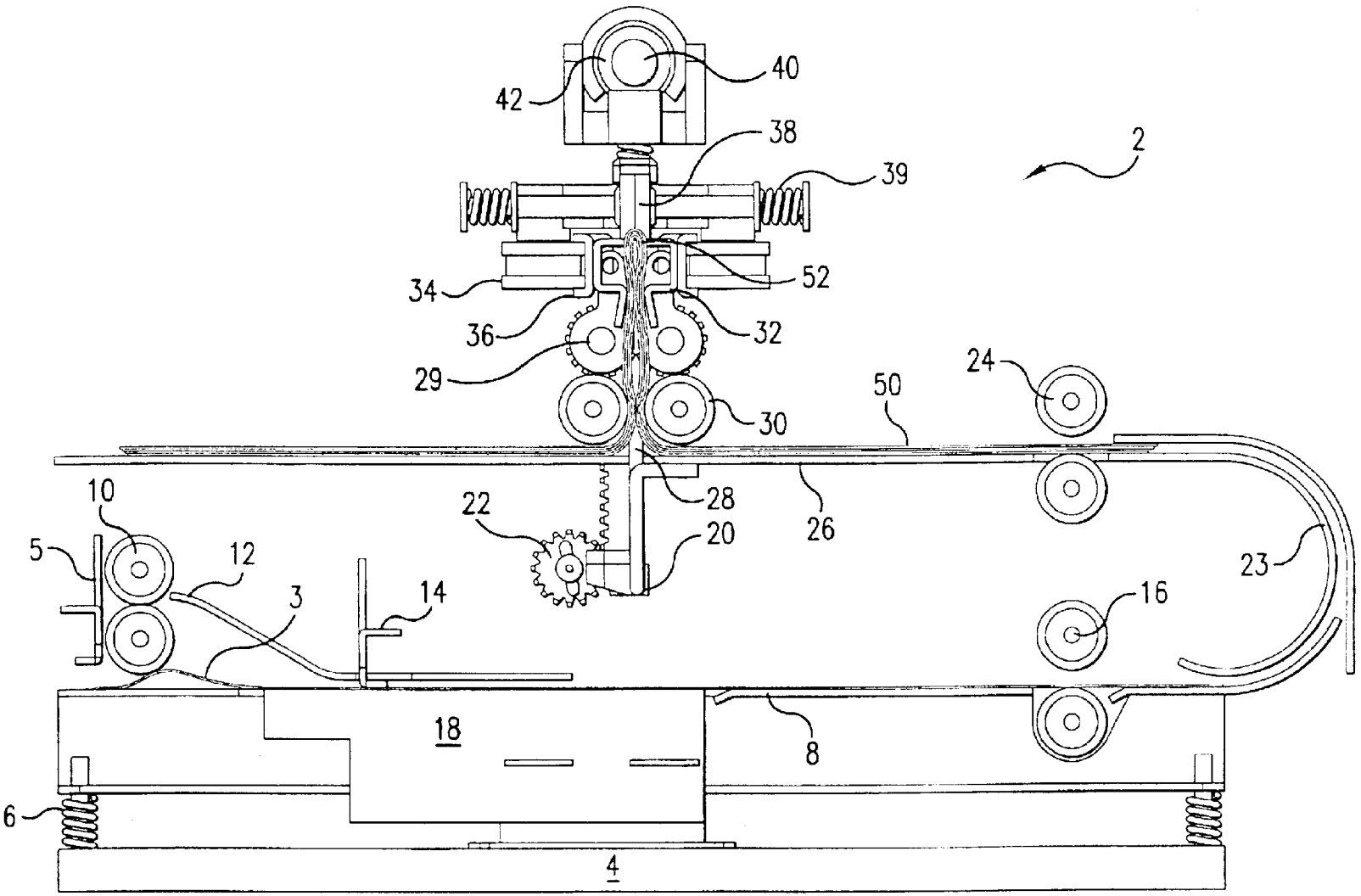
FIG. 10 is a front schematic illustration of the apparatus for creating a pillowless booklet, illustrating the spine flattening operation, according to another embodiment of the present invention.

As shown in FIG. 10, crease wire 28 and crease rollers 30 cause bundle 50 and spine 52 to traverse through clamping jaws 32 and interact with spine form roller 28. In this manner, clamping jaws 32 are caused to clamp down on bundle 50 and, more particularly, spine 52 in order to hold spine 52 in place to create a spine edge. After clamping jaws 32 have clamped down on bundle 50 and spine 52, V-shaped spine form roller 28 is traversed along the length of the edge of spine 52 through the use of carriage drive screw 40, drive nut 42, carriage-centering rollers 34, and guide rail 36 in order to flatten spine 52. Tensioners 39 are utilized in order to keep spine form roller 38 centered along spine 52 as spine form roller 38 flattens spine 52. In this manner, substantially any raised areas or "pillowing" located along spine 52 is eliminated.

Figure 11:
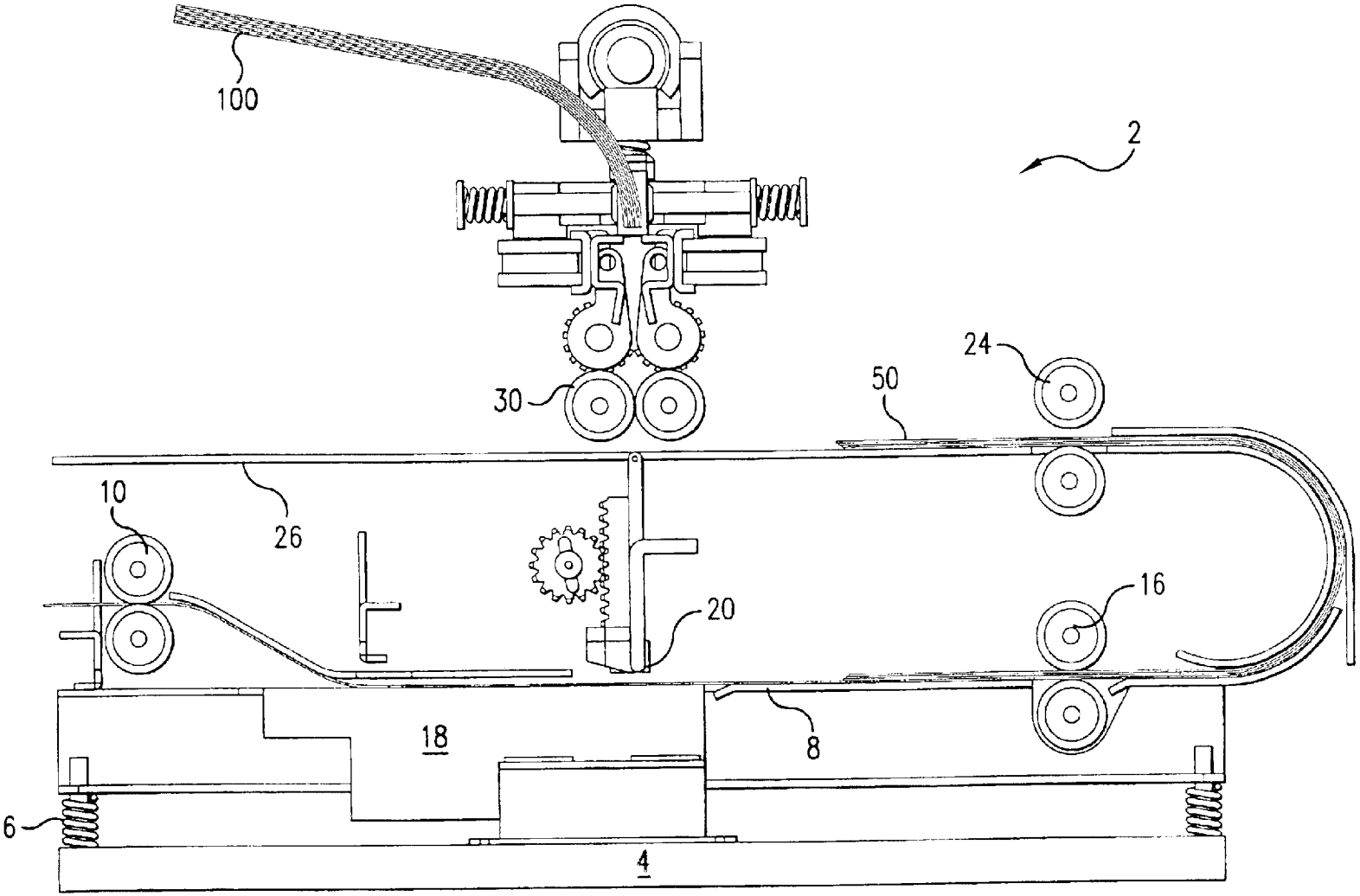
FIG. 11 is a front schematic illustration of the apparatus for creating a pillowless booklet, illustrating the booklet ejection operation.

As shown in FIG. 11, after booklet 100 has been formed and conventionally ejected from apparatus 2, another fastened bundle 50 is traversed from lower bundle plane 8 to upper bundle plane 26 so that another booklet 100 can be formed through the flattened of spine 52. It is to be understood that the present invention can be embodied in any computer-readable medium for use by or in connection with an instruction execution system such as a computer/processor based system or other system that can fetch or obtain the logic from the computer-readable medium and execute instructions contained therein. A "computer-readable medium" can be any medium that contains, stores, or maintains programming for use by or in connection with the instruction execution system. The computer-readable medium can comprise any one of many physical media such as, for example, electronic, magnetic, optical, electromagnetic, infrared, or semiconductor media. More specific examples of a suitable computer-readable medium would include, but are not limited to, a portable magnetic computer diskette such as floppy diskettes or hard drives, a random access memory (RAM), a read-only memory (ROM), an erasable programmable read-only memory, or a portable compact disc.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. An apparatus for creating a pillowless booklet, comprising:

a means for accumulating a plurality of sheets to form a bundle;

a means for fastening said plurality of sheets in said bundle operatively connected to said accumulating means;

a means for forming a booklet spine edge operatively connected to said fastening means; and a means for flattening said booklet spine edge in order to create a pillowless booklet operatively connected to said booklet spine forming means, further comprising; a crease wire; a crease roller located substantially adjacent to said crease wire; a guide rail operatively connected to said crease roller; a carriage roller operatively connected to said guide rail; and a clamp operatively connected to said guide rail.

2. The apparatus, as in claim 1, wherein said accumulating means is further comprised of:

a first clamp;

a first roller operatively connected to said first clamp;

a diverter operatively connected to said first roller;

a second clamp operatively connected to said diverter; and a second roller operatively connected to said second clamp.

3. The apparatus, as in claim 1, wherein said fastening means is further comprised of:

an anvil; and a stapler located substantially adjacent to said anvil.

4. The apparatus, as in claim 1, wherein said booklet spine edge flattening means is further comprised of:

a spine form roller.

5. A system for producing a pillowless booklet, comprising:

a sheet accumulator for accumulating a plurality of sheets to form a bundle;

a sheet fastener for fastening said plurality of sheets in said bundle operatively connected to said sheet accumulator;

a booklet spine edge former operatively connected to said fastener; and a booklet spine edge flattener operatively connected to said booklet spine edge former for flattening the booklet spine edge in order to create a pillowless booklet, further comprising; a crease wire; a crease roller located substantially adjacent to said crease wire; a guide rail operatively connected to said crease roller: a carriage roller operatively connected to said guide rail; and a clamp operatively connected to said guide rail.

6. The system, as in claim 5, wherein said sheet accumulator is further comprised of:

a first clamp;

a first roller operatively connected to said first clamp;

a diverter operatively connected to said first roller;

a second clamp operatively connected to said diverter; and a second roller operatively connected to said second clamp.

7. The system, as in claim 5, wherein said fastener is further comprised of:

an anvil; and a stapler located substantially adjacent to said anvil.

8. The system, as in claim 5, wherein said booklet spine edge flattener is further comprised of:

a spine form roller.

* * * * *